US008414270B2

(12) United States Patent
Sah et al.

(10) Patent No.: US 8,414,270 B2
(45) Date of Patent: Apr. 9, 2013

(54) SPEED CONTROL OF AN ELECTRICALLY-ACTUATED FLUID PUMP

(75) Inventors: Jy-Jen F. Sah, West Bloomfield, MI (US); Ali K. Naqvi, White Lake, MI (US); Vincent Rawls, Farmington Hills, MI (US); Nitinkumar R. Patel, Cypress, CA (US)

(73) Assignee: GM Global Technology Operations LLC, Detroit, MI (US)

( * ) Notice: Subject to any disclaimer, the term of this patent is extended or adjusted under 35 U.S.C. 154(b) by 295 days.

(21) Appl. No.: 12/944,800

(22) Filed: Nov. 12, 2010

(65) Prior Publication Data

US 2012/0121438 A1 May 17, 2012

(51) Int. Cl.
*B62D 11/02* (2006.01)

(52) U.S. Cl. ..... 417/18; 180/6.48

(58) Field of Classification Search ..... 417/18; 180/6.48
See application file for complete search history.

*Primary Examiner* — Charles Freay
*Assistant Examiner* — Patrick Hamo
(74) *Attorney, Agent, or Firm* — Quinn Law Group, PLLC

(57) ABSTRACT

A fluid system includes a fluidic device, an electrically-actuated fluid pump having a pump motor, and a control system. The control system controls a speed of the pump using a commanded torque value, and calculates a feedforward torque term as a function of a set of operating values, including a desired fluid line pressure. The control system determines the speed control torque term using pump speed error, and adds the feedforward torque term to the speed control torque term to calculate the commanded torque value. The speed control torque term may be determined using an integral term of a proportional integral derivative (PID) portion of the control system. A method for controlling pump speed includes calculating the feedforward torque term, determining the speed control torque term using a pump speed error, and adding the feedforward torque term to the speed control torque term to calculate the commanded torque value.

15 Claims, 1 Drawing Sheet

SPEED CONTROL OF AN ELECTRICALLY-ACTUATED FLUID PUMP

TECHNICAL FIELD

The present invention relates to a fluid system and method for controlling the speed of an electrically-actuated fluid pump.

BACKGROUND

Battery electric vehicles, extended-range electric vehicles, and hybrid electric vehicles all use a rechargeable high-voltage battery as an onboard source of electrical power for one or more traction motors. The traction motor(s) alternately draw power from and deliver power to the battery during vehicle operation. When the vehicle is propelled solely using electricity from the battery, the operating mode of the vehicle is typically referred to as an electric-only (EV) mode.

Vehicles that use torque from an internal combustion engine, whether for direct mechanical propulsion or to generate electricity for powering the traction motor(s) or charging the battery, may use an engine-driven fluid pump to circulate lubricating and/or cooling fluid to various powertrain components. Clutches, valve bodies, gear sets, and other wetted or fluidic components are thus provided with a reliable supply of fluid during engine-on transmission operating modes. However, an engine-driven main pump is not available in every transmission operating mode, such as when operating in an EV mode. Moreover, certain vehicle designs dispense of an engine-driven main pump altogether. Therefore, an electrically-actuated fluid pump may be used either as an auxiliary pump when an engine-driven main pump is present, or as the vehicle's sole fluid pump.

SUMMARY

Accordingly, a fluid system is provided herein that includes a fluidic device, e.g., a clutch or a gear element, an electrically-actuated fluid pump having a pump motor, and a control system. The fluid pump circulates oil, transmission fluid, or other fluid to the fluidic device. The fluid pump may be used either as an auxiliary pump or as a main pump, for example as a transmission oil pump aboard a vehicle. The control system controls a speed of the fluid pump via the pump motor using a commanded torque value. The control system calculates the commanded torque value as a function of a feedforward torque term and a closed-loop/feedback speed control torque term, as set forth in detail herein.

The feedforward torque term is determined by the control system using a predetermined set of operating values, including at least a desired fluid line pressure, and potentially including a fluid temperature and a calibrated pump motor inertia value. The control system also determines the closed-loop speed control torque term using a speed error of the fluid pump, for example using an integral control term of a proportional integral (PI) or a proportional integral derivative (PID) controller portion of the present control system. The control system then adds the feedforward torque term to the closed-loop speed control torque term to determine the commanded torque value, which is transmitted to the pump motor to provide speed control of the fluid pump.

In one possible embodiment, the control system automatically limits a rate of the closed-loop speed control torque term and the feedforward torque term using a calibrated limit.

A method for controlling a speed of the electrically-actuated fluid pump noted above includes calculating, via the control system, a feedforward torque term as a function of the set of operating values, including a desired fluid line pressure. The method further includes determining the closed-loop/feedback speed control torque term using a speed error of the fluid pump, and adding the feedforward torque term to the closed-loop speed control torque term to thereby calculate the commanded torque value. The speed of the fluid pump is then automatically controlled by the control system using the commanded torque value, e.g., by transmitting the commanded torque value to the pump motor.

A method for controlling a speed of an electrically-actuated fluid pump includes calculating, via the control system, a feedforward torque term as a function of a set of operating values, including a desired fluid line pressure. The method also includes determining a closed-loop speed control torque term using a speed error of the fluid pump, and adding the feedforward torque term to the closed-loop speed control torque term via the control system to thereby calculate a commanded torque value. The control system then transmits the commanded torque value to the pump motor to thereby control the speed of the fluid pump.

The above features and advantages and other features and advantages of the present invention are readily apparent from the following detailed description of the best modes for carrying out the invention when taken in connection with the accompanying drawings.

DESCRIPTION

Figure 1:
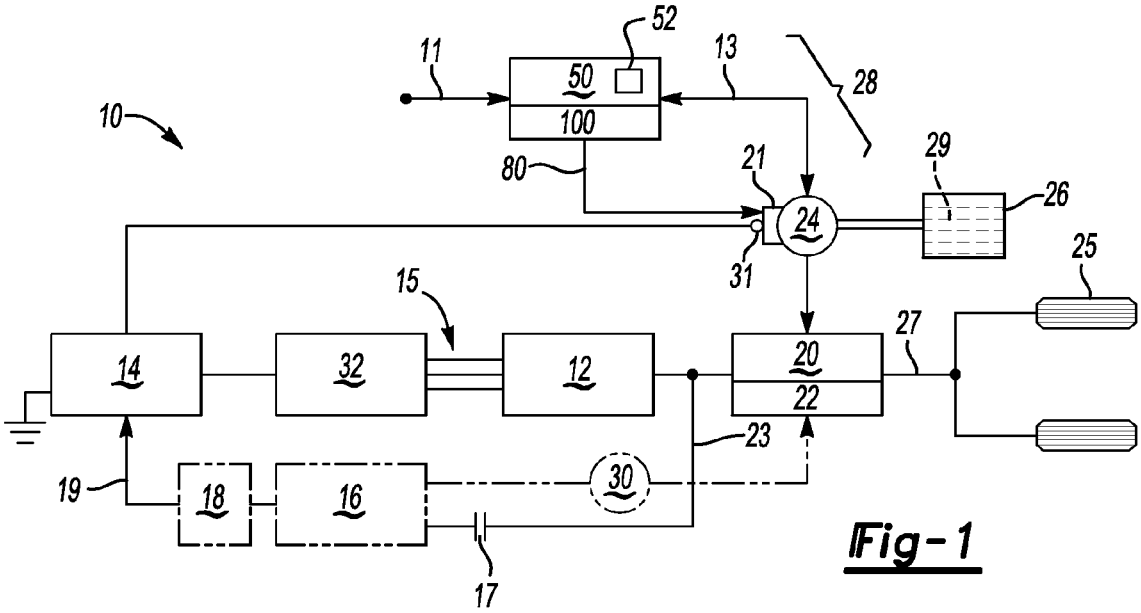
FIG. 1 is a schematic illustration of a vehicle having a control system configured for controlling a speed of an electrically-actuated fluid pump.

Referring to the drawings, wherein like reference numbers correspond to like or similar components throughout the several figures, a vehicle 10 is shown in FIG. 1. The vehicle 10 includes a fluid system 28 having a control system 50, an electrically-actuated fluid pump 24, and a fluidic device 22 such as a clutch. The vehicle 10 shown in FIG. 1 is a typical host system in which the fluid system 28 may be used. However, other non-vehicular host systems may also be envisioned, e.g., hydraulic machines or other fluid-powered equipment. For illustrative purposes, an embodiment in which the vehicle 10 of FIG. 1 is the host system will be described herein.

The control system 50 provides automatic speed control of the fluid pump 24 within the fluid system 28. The fluid pump 24 is powered or actuated by an electric pump motor 21, and may be used either as a primary fluid pump or as an auxiliary or backup fluid pump depending on the design of the vehicle 10 or other host system. In one possible embodiment, the fluid pump 24 may be configured as an auxiliary fluid pump that is selectively energized only when an optional internal combustion engine 16 or other prime mover is not running. Such a condition may occur during an electric-only (EV) operating mode of the vehicle 10 when configured as a hybrid electric vehicle.

Automatic speed control of the fluid pump 24 is provided herein via an additively combined open-loop feedforward torque term and a closed-loop/feedback speed control torque term, both of which are explained in detail below with reference to FIGS. 2-4. As is well understood in the art, and as used herein, the control terms "feedforward" and "feedback" refer to the relationship between a controlled variable and the control system being used to monitor and control that particular variable. Closed-loop feedback control involves measuring the controlled variable, comparing it to a calibrated set point, determining the direction and magnitude of the error, and adjusting the set point in response to that error. Feedforward control attempts to adjust the setpoint(s) in response to any system disturbances before the disturbances can affect system performance to any appreciable degree. Accurate prediction of possible disturbances is thus required in advance using feedforward control, while feedback control responds to these disturbances as they occur.

Still referring to FIG. 1, the feedforward torque term of the present control system 50 can be calibrated such that a torque command value being transmitted as a control signal to the fluid pump 24, via the pump motor 21, closely approximates a final torque value needed for achieving a desired pump rotational speed. By using feedforward control in conjunction with feedback control as disclosed herein, the control system 50 is faster to respond relative to a conventional proportional integral derivative (PID) feedback control scheme. That is, the time lag or delay in using a PI or PID control scheme is largely minimized when driving pump speed error to zero, as will be appreciated by those of ordinary skill in the art.

The vehicle 10 shown in FIG. 1 may include a traction motor 12 and a high-voltage energy storage system (ESS) 14, e.g., a multi-cell rechargeable battery pack. While only one traction motor 12 is shown for simplicity, multiple traction motors may be used in the alternative depending on the vehicle design. The vehicle 10 may be configured as a hybrid electric vehicle (HEV), a battery electric vehicle (BEV), or an extended-range electric vehicle (EREV) within the intended inventive scope. Such vehicles can generate motor torque using the traction motor 12 at levels suitable for propelling the vehicle in an EV mode.

In some vehicle designs, an internal combustion engine, e.g., the engine 16, may be used to selectively generate engine torque via an engine output shaft 23. Torque from the engine output shaft 23 can be used to either directly propel the vehicle 10, for example in an HEV design, or to power an electric generator 18, e.g., in an EREV design, as noted elsewhere above. The generator 18 can deliver electricity (arrow 19) to the ESS 14 at levels suitable for charging the ESS. An input clutch and damper assembly 17 may be used to selectively connect/disconnect the engine 16 from a transmission 20. Input torque is ultimately transmitted from the traction motor 12 and/or the engine 16 to a set of drive wheels 25 via an output member 27 of the transmission 20.

The traction motor 12 may be a multi-phase permanent magnet/AC induction machine rated for approximately 60 volts to approximately 300 volts or more depending on the vehicle design. The traction motor 12 is electrically connected to the ESS 14 via a power inverter module (PIM) 32 and a high-voltage bus bar 15. The PIM 32 is any device capable of converting DC power to AC power and vice versa. The ESS 14 may be selectively recharged using torque from the traction motor 12 when the traction motor is actively operating as generator, e.g., by capturing energy during a regenerative braking event. In some embodiments, such as plug-in HEV (PHEV), the ESS 14 can be recharged via an off-board power supply (not shown) whenever the vehicle is not running.

The transmission 20 has at least one fluidic device 22. As used herein, the term "fluidic device" means a fluid-actuated, lubricated, and/or cooled device that is used as part of the powertrain of vehicle 10. In one possible embodiment, the fluidic device 22 may be a torque transfer mechanism such as a brake or a rotating clutch. The fluidic device 22 may include various gear sets of the transmission 20, and/or any other fluid-lubricated or fluid-cooled device of the vehicle 10. For simplicity, the fluidic device 22 is shown as part of the transmission 20, but the location is not necessarily limited to the transmission. For example, the traction motor 12 may itself be the fluidic device 22, with fluid used to cool the coils or windings (not shown) of the motor.

Still referring to FIG. 1, the fluid pump 24 is in fluid communication with the transmission 20 and a sump 26 containing a supply of fluid 29 such as oil or transmission fluid. The fluid pump 24 may be configured as a high-voltage device using the pump motor 21, which is energized by the ESS 14 in one possible embodiment. In some vehicle designs, an optional engine-driven main pump 30 may be used to circulate fluid 29 to the fluidic device 22 and/or to other locations during various engine-on operating modes. However, when the vehicle 10 is traveling in an EV mode, such a main pump is temporarily unavailable. As noted above, in other designs a main pump may be entirely absent, e.g., a BEV design, and in some cases in an EREV or HEV design, for example to reduce cost and/or vehicle weight.

The control system 50 is electrically connected to the fluid pump 24, and is configured for automatically controlling its speed. The control system 50 does so in part by executing a method 100, which resides in non-transitory or tangible memory within the control system or is otherwise readily executable by associated hardware components of the control system as needed. Contrary to the engine-driven main pump 30, the fluid pump 24 operates independently of engine speed. The speed of the fluid pump 24 is instead controlled as a function of a desired fluid line pressure, and potentially as a function of other operating values, with a generated feedforward torque term then used in conjunction with a closed-loop speed control torque term as set forth below.

A set of input signals 11 communicates the various operating values to the control system 50 when executing the present method 100. The set of input signals 11 may include, in addition to the desired fluid line pressure noted above, an actual fluid line pressure, a known or modeled fluid leak rate of a designated oncoming clutch, a geometric model of any oncoming clutches, fluid passage size and/or distribution within a particular valve body of the transmission 20, transmission fluid temperature, a pump motor inertia value, fluid viscosity information, actual fluid line pressure, etc.

A pump speed value (arrow 13) is communicated to the control system 50 from the fluid pump 24, e.g., via a speed sensor 31 positioned in proximity to the pump motor 21. The pump speed value (arrow 13) describes an actual rotational speed of the pump motor 21. At least some of the set of input signals (arrow 11) can be used with a lookup table (LUT) 52 to calculate the feedforward torque term and other values needed for controlling the speed of the fluid pump 24.

Figure 2:
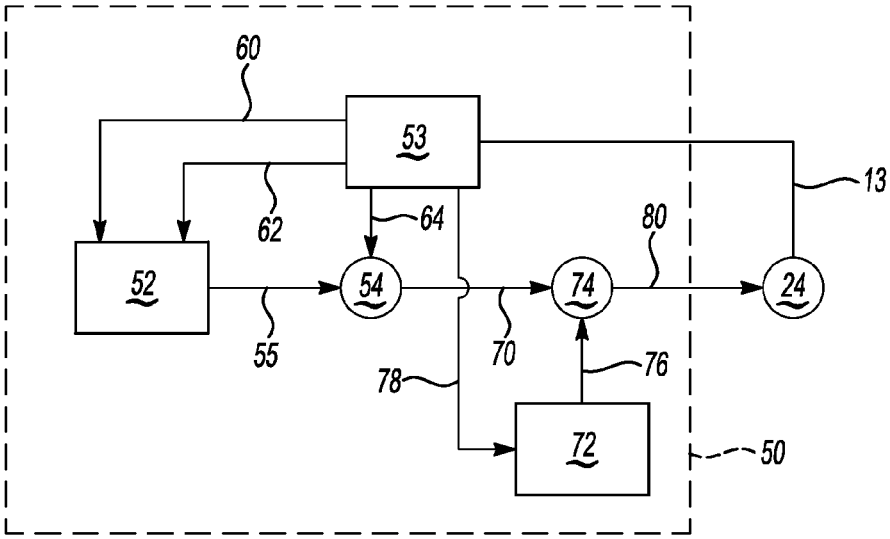
FIG. 2 is a logic flow diagram for the control system of the vehicle shown in FIG. 1.

Referring to FIG. 2, the control system 50 shown in FIG. 1 is described in terms of its logic flow. Non-transient/tangible memory 53 of the control system 50 can store the LUT 52 for rapid access by any associated hardware components of the control system. The LUT 52 may be indexed by at least some of the set of vehicle operating values, including at least a desired fluid line pressure (arrow 60), which may be a calibrated value for the present transmission operating mode. The LUT 52 may also be indexed by another vehicle operating value, e.g., a fluid temperature (arrow 62) of the fluid 29 shown in FIG. 1. The LUT 52 outputs an intermediate torque value (arrow 55), which is added to a calibrated pump motor inertia value (arrow 64) at a first computational node 54. The pump motor inertia value (arrow 64) depends on the particular design, structure, and operating physics of the fluid pump 24, and may be a calibrated value that is provided by the manufacturer or otherwise determined beforehand and stored in memory 53.

The feedforward torque term (arrow 70) is output from the first computational node 54 to a second computational node 74. Within node 74, the feedforward torque term (arrow 70) is added to a speed control torque term (arrow 76), which may be an integral term taken from a proportional integral derivative (PID) controller 72, i.e., a PID logic portion of the control system 50. As is well understood by those of ordinary skill in the art, a PID controller uses various software and hardware elements to determine a speed error, such as a pump speed error (arrow 78). The pump speed error (arrow 78) may be temporarily stored in memory 53 after being calculated by the control system 50 using the speed values (arrow 13) from the fluid pump 24, and using any calibrated reference values. The pump speed error (arrow 78) describes a closed-loop speed error of the fluid pump 24, and the speed control torque term (arrow 76) ultimately commands a desired pump rotational speed. Node 74 outputs the torque command value (arrow 80), which is ultimately transmitted as a control signal to the fluid pump 24, or more precisely the pump motor 21, and used to control the pump speed.

The logic flow of FIG. 2 addresses a particular control problem wherein closed-loop feedback control used alone, i.e., from a PID controller, is slow to converge on a desired speed when a large speed change is commanded. The present control system 50 therefore adds the feedforward torque (arrow 70) to the closed-loop speed control torque term (arrow 76) to increase the responsiveness of the control system 50 with respect to control of the fluid pump 24. This occurs in part by providing an accurate estimate of the amount of motor output torque required from the pump motor 21 (see FIG. 1) in order to achieve a desired pump speed control point. This estimate is otherwise absent using a PID or PI feedback control scheme operating alone. As a result, the ability to provide a consistent desired fluid line pressure is optimized, potentially resulting in an improved gear shift quality and other potential benefits.

Figure 3:
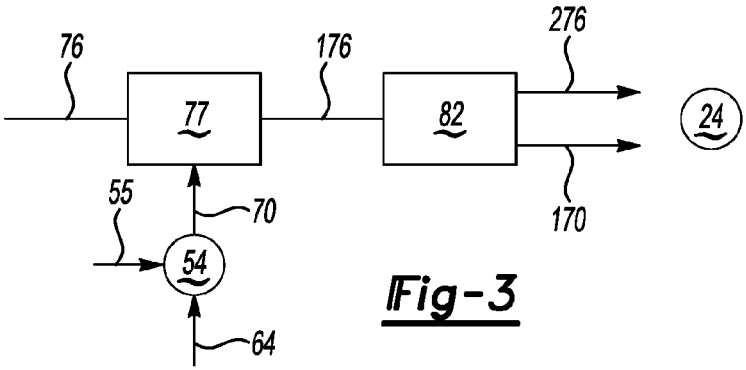
FIG. 3 is another logic flow diagram for the control system of the vehicle shown in FIG. 1.

Referring to FIG. 3, in one possible embodiment the control system 50 of FIG. 1 includes an optional power moding/conversion module 77 which converts the speed control torque term (arrow 76) from a percentage of a calibrated maximum pump speed into an actual speed command (arrow 176) in revolutions per minute (RPM). The conversion module 77 is also configured to ensure that when the fluid pump 24 is inactive, the actual speed command (arrow 176) is generated with a zero value.

The feedforward torque term (arrow 70) and the actual speed command (arrow 176) may be additionally processed using an optional rate limiting module 82. The rate limiting module 82 ensures a smooth transition during a change of speed, and may include a calibrated rate or ramp limit to which a change in either or both of the actual speed command (arrow 176) and the feedforward torque term (arrow 70) are compared. A rate-limited desired speed (arrow 276), in RPM, and a rate-limited feedforward torque term (arrow 170) are then added at node 74 (see FIG. 2) and passed to the fluid pump 24, thereby controlling the pump speed.

Figure 4:
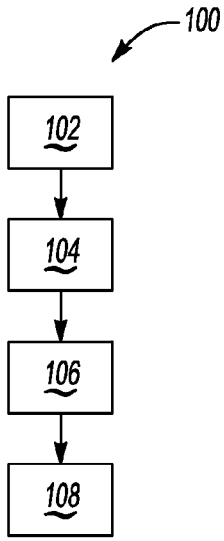
FIG. 4 is a flow chart describing a method for controlling the speed of the electrically-actuated fluid pump aboard the vehicle shown in FIG. 1.

Referring to FIG. 4, the method 100 according to one possible embodiment begins with step 102, wherein a set of operating values are determined via the control system 50 of FIG. 1. As noted above, the operating values may include a desired fluid line pressure, an actual fluid temperature, and a calibrated inertia value of the fluid pump 24, as respectively indicated in FIG. 2 by arrows 60, 62, and 64. Step 102 may entail determining the present transmission operating mode, vehicle speed, transmission output speed, or any other values needed for executing method 100. Once the set of operating values is determined, the method 100 proceeds to step 104.

At step 104, the control system 50 calculates the feedforward torque term (arrow 70 of FIG. 2). Step 104 may include referencing the LUT 52 of FIGS. 1 and 2, which may be indexed by one or more of the desired fluid line pressure and fluid temperature as noted above, and adding a value from the LUT to a torque value indicated by the inertia value of the pump 24, i.e., a torque needed for overcoming the inherent inertia of the pump. Alternatively, step 104 may calculate the feedforward torque term as a function of any or all of the operating values noted above. The method 100 then proceeds to step 106.

At step 106, the control system 50 determines a feedback speed error for the fluid pump 24, e.g., using a PID controller as shown in FIG. 3. Using this error, the control system 50 determines the closed-loop speed control torque (arrow 76) as shown in FIG. 2, or alternatively the actual speed command (arrow 176) or the rate-limited actual speed command (arrow 276) shown in FIG. 3. Once determined, the method 100 proceeds to step 108.

At step 108, the control system 50 transmits the torque command value (arrow 80 of FIG. 3) as a control signal to the pump motor 21, and thereby controls the speed of the fluid pump 24. Step 108 may entail adding the feedforward torque term (arrow 70 of FIG. 2) to the closed-loop speed control torque term (arrow 76 of FIG. 2). The response time of the control system 50 is thus optimized with respect to speed control of the fluid pump 24.

While the best modes for carrying out the invention have been described in detail, those familiar with the art to which this invention relates will recognize various alternative designs and embodiments for practicing the invention within the scope of the appended claims.

The invention claimed is:

1. A system comprising: an internal combustion engine; a fluidic device; an electrically-actuated fluid pump in fluid communication with the fluidic device, wherein the fluid pump includes a pump motor; and a control system operable for controlling a speed of the fluid pump via the pump motor, wherein the control system is configured for: calculating a feedforward torque term as a function of a set of operating values, including a desired fluid line pressure; determining a closed-loop speed control torque term using a speed error of the fluid pump; adding the feedforward torque term to the closed-loop speed control torque term to thereby calculate a commanded torque value; and transmitting the commanded torque value to the pump motor to thereby control the speed of the fluid pump, wherein the control system is configured for determining when the engine is not running, and for controlling the speed of the fluid pump only when the engine is not running.

2. The system of claim 1, wherein the set of vehicle operating values further includes a temperature of the fluid and an inertia value of the fluid pump.

3. The system of claim 1, wherein the closed-loop speed control torque term is determined by using an integral term of a proportional integral derivative (PID) portion of the control system.

4. The system of claim 1, wherein the fluidic device is a fluid-actuated clutch.

5. The system of claim 1, wherein the control system automatically references a lookup table that is indexed at least in part by the desired fluid line pressure in calculating the feedforward torque term.

6. The system of claim 1, wherein the control system automatically limits a rate of the closed-loop speed control torque term and the feedforward torque term.

7. A method for controlling a speed of an electrically-actuated fluid pump, the method comprising: calculating, via a control system, a feedforward torque term as a function of a set of operating values, including a desired fluid line pressure; determining a closed-loop speed control torque term using a speed error of the fluid pump; adding the feedforward torque term to the closed-loop speed control torque term via the control system to thereby calculate a commanded torque value; and transmitting the commanded torque value from the control system to the pump motor to thereby control the speed of the fluid pump, wherein the fluid pump is configured for use as an auxiliary fluid pump in a vehicle having an internal combustion engine, the method further comprising: determining when the engine is not running; and supplying fluid via the fluid pump to the fluidic device only when the engine is not running.

8. The method of claim 7, wherein the set of operating values further includes: a temperature of a fluid circulated by the fluid pump, and a calibrated inertia value of the fluid pump.

9. The method of claim 7, wherein determining the closed-loop speed control torque term includes using an integral term of a proportional integral derivative (PID) portion of the control system.

10. The method of claim 7, wherein calculating the feedforward torque term includes referencing, via the control system, a lookup table that is indexed at least in part by the desired fluid line pressure.

11. The method of claim 7, further comprising:

automatically limiting a rate of the closed-loop speed control torque term and the feedforward torque term.

12. A method for controlling a rotational speed of an electrically-actuated auxiliary fluid pump in a hybrid electric vehicle, wherein the auxiliary fluid pump includes a pump motor, and wherein the vehicle includes a control system and torque transmitting mechanism, the method comprising:

calculating, via the control system, a feedforward torque term as a function of a desired fluid line pressure, a temperature of a fluid circulated by the auxiliary fluid pump, and a calibrated inertia value of the auxiliary fluid pump, including referencing a lookup table that is indexed by the desired fluid line pressure and the temperature of the fluid;

using an integral term of a proportional integral derivative (PID) portion of the control system to determine a closed-loop speed control torque term;

adding the feedforward torque term to the closed-loop speed control torque term to thereby calculate a commanded torque value; and transmitting the commanded torque value from the control system to the pump motor to thereby control the speed of the auxiliary fluid pump when an engine of the hybrid electric vehicle is not running.

13. The method of claim 12, further comprising:

using the control system to command a zero speed value from the auxiliary fluid pump when the engine is running.

14. The method of claim 13, further comprising:

automatically limiting a rate of the closed-loop speed control torque term and the feedforward torque term.

15. The method of claim 14, further comprising:

converting, via the control system, a first desired speed of the auxiliary fluid pump to a second desired pump speed, wherein the first desired speed is a percentage of a calibrated maximum pump speed of the auxiliary fluid pump and the second desired pump speed is a corresponding actual rotational speed of the auxiliary fluid pump in revolutions per minute.

* * * * *